United States Patent [19]

Hofer et al.

[11] 4,409,588

[45] Oct. 11, 1983

[54] MINIATURE SOUNDER WITH MULTI-PART TUNED CAVITIES

[75] Inventors: Alan Hofer, Wantaugh; Frank M. Yama, Massapequa, both of N.Y.

[73] Assignee: Pickering & Company, Inc., Plainview, N.Y.

[21] Appl. No.: 242,347

[22] Filed: Mar. 10, 1981

[51] Int. Cl.[3] ..... G08B 3/10

[52] U.S. Cl. ..... 340/384 R; 181/160; 340/388

[58] Field of Search ..... 340/384 R, 388; 181/160, 155, 156

[56] References Cited

U.S. PATENT DOCUMENTS

| | | | |
|---|---|---|---|
| 3,952,159 | 4/1976 | Schott | 181/156 X |
| 3,980,154 | 9/1976 | Johnson | 181/160 X |
| 4,251,807 | 2/1981 | Hofer et al. | 340/384 R |

*Primary Examiner*—John W. Caldwell, Sr.
*Assistant Examiner*—Daniel Myer
*Attorney, Agent, or Firm*—Kane, Dalsimer, Kane, Sullivan and Kurucz

[57] ABSTRACT

A miniature sounder having a diaphragm closing one end of a tuned chamber. The other end of the chamber communicates with the interior of a tuned housing through which an open-ended enclosure extends. The oscillating frequency of the diaphragm. The housing and enclosure are tuned to resonate at the desired frequency.

5 Claims, 4 Drawing Figures

MINIATURE SOUNDER WITH MULTI-PART TUNED CAVITIES

BACKGROUND OF THE INVENTION

The present invention relates to miniaturized sounders and in particular to a buzzer for a pocket paging device or the like.

Pocket pagers have gained wide use and acceptance in recent years. Such pages are commonly used by physicians, repair technicians, and others who must remain in contact with a central location. The pager, which corresponds in size roughly to that of a cigarette package, is carried in a pocket or clipped to the clothing of the user. In one common type of paging system, a radio signal at a particular frequency is generated when contact with the user is required. The radio signal serves to trigger an oscillator within the pager which, in turn, drives a buzzer. The user, upon hearing the buzzer, places a telephone call to the central location to receive his message.

Pocket pagers must be small enough to be comfortably carried by the user. In addition, the pager must be large enough to contain the buzzer along with its associated electronics and power supply. It is thus desirable to miniaturize the components of the pager as much as possible. This poses a particular problem with regard to the actual sounder since it must be capable of generating a sound sufficiently loud to insure attracting the user's attention regardless of ambiant noise conditions.

Heretofore, various attempts have been made to produce such miniature sounders or buzzers. In one such attempt, a folded horn is positioned within a tuned cavity. This, however, requires precise tuning of the buzzer components. In our co-pending application Ser. No. 236,001 filed Feb. 19, 1981 for MINIATURE SOUNDER WITH DOUBLE TUNED CAVITY, a sounder is provided which relies on the tuning of cavities within the sounder housing. A problem of these prior art devices is that since the sounder components are tuned to a particular frequency, in the event of a frequency shift the output will deteriorate. This may or may not be desirable depending upon the ultimate use of the sounder. The "Q" of the sounder is a measure of the sensitivity of the sounder to frequency shift. The lower the Q, the less susceptible the sounder output will be to variations in the drive frequency.

In view of the above, it is the principal object of the present invention to provide an improved sounder which is small in volume, capable of producing a relatively loud, audible sound and in which the Q may be controlled to some extent as required for particular usages.

A further object is to provide such a sounder which is compatible with conventional pocket pager drive circuits and power sources.

A still further object is to provide such a sounder which is reliable, efficient and which may be constructed of a small number of components which may be readily assembled.

SUMMARY OF THE INVENTION

The above and other beneficial objects and advantages are attained by providing a miniature sounder comprising a double tuned cavity resonator in which the Q value of the resonator may be altered by varying the ratio of components of the cavities.

The sounder includes a diaphragm disposed within a housing. An open-ended, two portion chamber extends from the diaphragm. An open-ended enclosure extends into the housing. The volume of the chamber and the combined volumes of the housing and enclosure are tuned to the desired harmonic of the drive frequency of the diaphragm. By varying the ratio of the enclosure volume to housing volume and/or chamber first portion to chamber second portion variation in the Q of the sounder may be obtained.

BRIEF DESCRIPTION OF THE PREFERRED EMBODIMENT

Figure 1:
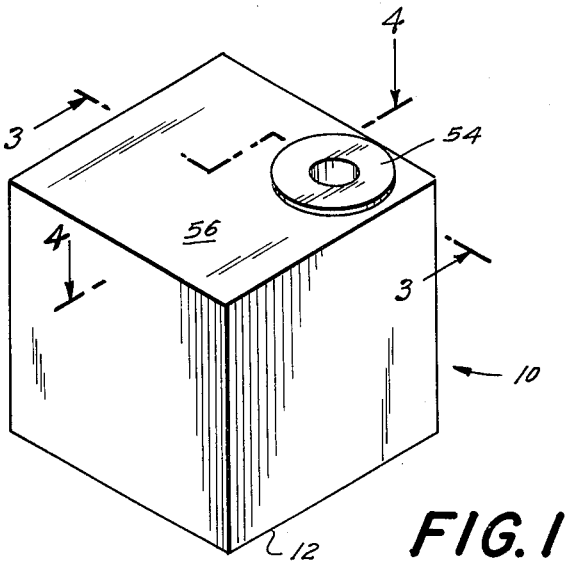
FIG. 1 is a perspective view of a miniature sounder in accordance with the present invention.
Figure 2:
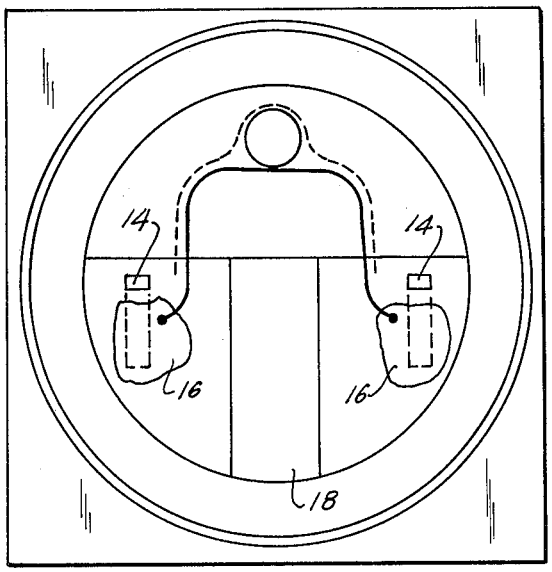
FIG. 2 is a bottom plan view of the sounder of FIG. 1.

Reference is now made to the drawings and to FIG. 1 in particular wherein a miniature sounder 10 in accordance with the present invention is depicted. The sounder 10 is contained within a generally cubic housing 12 formed of a suitable material such as ABS plastic or the like. The sides of housing 10 are approximately 0.535" by 0.555" and the height of the unit is approximately ½".

A pair of connectors 14 extend from the bottom of the housing where they engage the contacts 16 of a solder patch 18. The ends of a coil are similarly connected to the solder patch thereby permitting the coil to be activated through connectors 14. The connectors 14 facilitate seating and securing the sounder 10 into a socket in the pocket pager assembly or other device with which the sounder is to be used and also serve to make electrical contact with an oscillator forming a part of the pager drive circuit. Such pagers are well known and are well defined in the art and form no part of the present invention.

Figure 3:
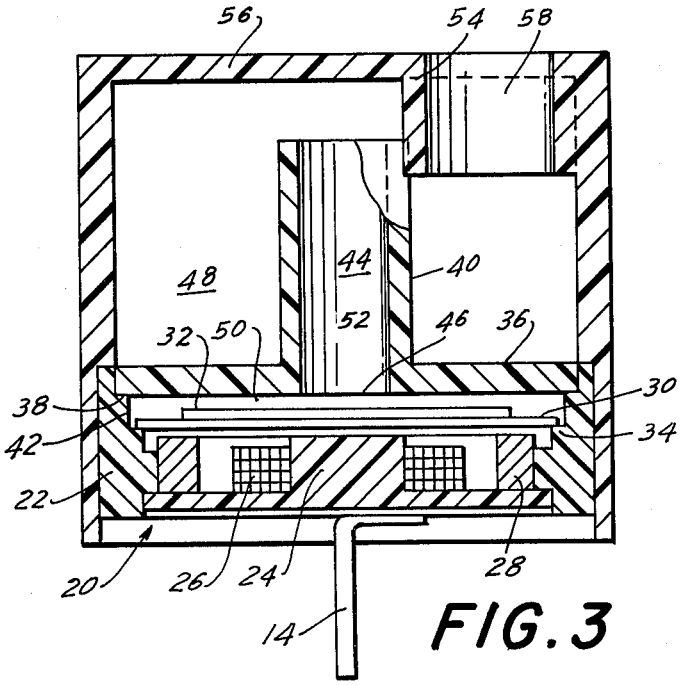
FIG. 3 is a sectional view along reference lines 3—3 of FIG. 1 in the direction of the arrows; and, FIG. 4 is a sectional view along reference lines 4—4 of FIG. 1 in the direction of the arrows.
Figure 4:
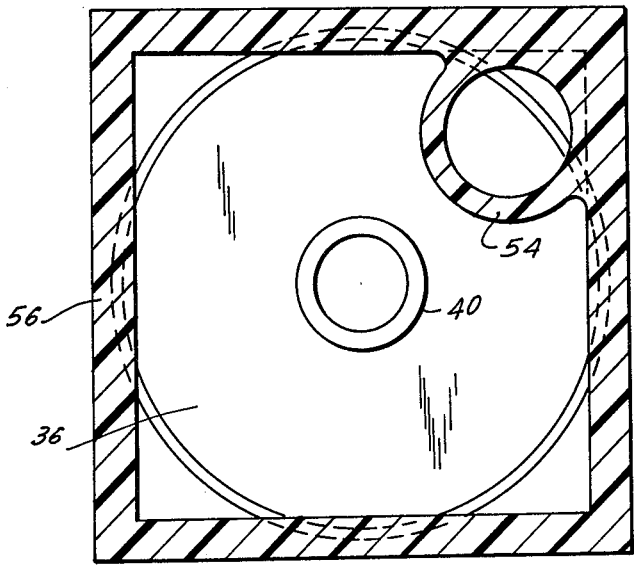

Referring now to FIG. 3, it can be noted that there is contained at the bottom of the housing a driver generally designated 20. The driver 20 is of a conventional construction and may, for example, be constructed in accordance with the teachings of our commonly assigned U.S. Pat. No. 4,251,807 for MINIATURE BUZZER. In brief, the driver 20 consists of a plastic support collar 22 in which a pole piece 24 of a magnetic material is supported. A coil 26 is disposed about the pole piece. The ends of the coil 26 are drawn through the bottom of the unit for connection with contacts 14 through the solder patch 18 as described. A ring magnet 28 surrounds the coil with its upper edge defining a common plane with the top of the pole piece.

A diaphragm 30 formed of a tempered magnetic material is positioned within collar 22 spaced above the top edge of the pole piece 24. An armature 32 of magnetic material is spot welded to the rear of the diaphragm (i.e., opposite to the pole piece). The diameter of the armature is less than that of the diaphragm but large enough to span the inner diameter of ring magnet 28. The diaphragm 30 fits onto a step 34 formed in collar 22. A closure plate 36 fits on a lower step 38 formed at the top of collar 22. A hollow tube 40 extends upwardly from an opening through plate 36. Thus, the upper portion 42 of collar 22 (i.e., above step 34) along with the bore 44 of tube 40 define an open-ended chamber 46 the bottom end of which is closed by the diaphragm 30 and the top end of which communicates with the interior 48 of housing 12. Chamber 46 is made up of two portions, a first portion 50 (occupying a volume $V_1$) between the diaphragm 30 and plate 36 and a second portion 52 (occupying a volume $V_2$) comprising the interior of tube 40.

An open-ended enclosure 54 in the form of a tube extends from the bottom 56 of housing 12 into the housing interior. The interior 58 of enclosure 54 occupies a volume $V_4$ determined by its height and diameter. The housing interior 48 occupies a volume $V_3$ determined by its dimensions.

By varying the diameter of collar 22 above diaphragm 30 and/or the distance between diaphragm 30 and plate 36 and/or the diameter and length of tube 40 the volume of the chamber and hence its resonant frequency may be altered. Similarly the resonant frequency of the housing may be altered by varying the dimensions of the sides or the height of the housing. Thus, the volume of the chamber and the combined volume of the housing and enclosure may be tuned to the frequency or a harmonic of the oscillator driving diaphragm 30.

In a successful practice of the invention wherein the diaphragm was oscillated at approximately 2000 Hz chamber 46 was tuned to 6000 Hz and the interior 48 of housing 12 and enclosure 54 were tuned to 2000 Hz. Enclosure 54 was 0.125" long and had a diameter of 0.135". To vary the Q of the system the ratio $V_1/V_2$ and/or the ratio $V_4/V_3$ can be varied. Reducing either ratio lowers the Q of the unit thereby making the loudness of the output sound less dependent on slight variations in the drive frequency. Conversely, it if were desirable to raise the Q of the unit one or both of the above ratios could be increased.

Thus, in accordance with the above, the aforementioned objects are attained.

Having thus described the invention, what is claimed is:

1. A miniature sounder comprising:

a diaphragm;

a surrounding housing disposed about said diaphragm;

an open-ended chamber dimensioned to resonate at a predetermined frequency positioned within said housing, said chamber having a first portion including a first open end closed by said diaphragm and a second portion including an opposite open end communicating with the interior of said housing;

an armature affixed to said diaphragm;

a magnetic circuit operatively connected to said armature for driving said diaphragm at a desired frequency; and, an open-ended enclosure positioned within said housing providing an outlet from said sounder; said open-ended chamber having a volume tuned to a subharmonic of said desired frequency and said open-ended enclosure and housing having a combined volume tuned to said desired frequency.

2. The miniature sounder in accordance with claim 1 wherein said chamber has a resonant frequency substantially three times said desired frequency.

3. The miniature sounder in accordance with claim 1 or 2 wherein said enclosure comprises a tube.

4. The miniature sounder in accordance with claim 1 wherein said diaphragm frequency comprises approximately 2070 Hz, said chamber is tuned to a resonant frequency of approximately 6200 Hz, and said housing and enclosure combined are tuned to a resonant frequency of approximately 2070 Hz.

5. The miniature sounder in accordance with claim 1 wherein said housing is cubical.

* * * * *